United States Patent [19]

Freer

[11] 4,260,138

[45] Apr. 7, 1981

[54] PICKET FENCE

[76] Inventor: Lyle L. Freer, 317 SW. 7th, Wadena, Minn. 56284

[21] Appl. No.: 74,820

[22] Filed: Sep. 12, 1979

[51] Int. Cl.[3] ..... E04H 17/16

[52] U.S. Cl. ..... 256/19; 256/12.5

[58] Field of Search ..... 256/19, 12.5, 24, 25; 47/44, 45, 46, 47, 33; D25/43

[56] References Cited

U.S. PATENT DOCUMENTS

| | | | |
|---|---|---|---|
| D. 209,212 | 11/1967 | De Paolo | 256/19 X |
| 2,628,823 | 2/1953 | Rhome et al. | 256/26 |
| 3,604,685 | 9/1971 | Pokryfki | 256/25 |
| 3,700,213 | 10/1972 | Blease | 256/19 |
| 3,711,066 | 1/1973 | Niemlec | 256/19 |
| 3,892,387 | 7/1975 | Mann | 256/24 |
| 3,902,703 | 9/1975 | Bouye | 256/24 |
| 4,022,436 | 5/1977 | Thomas | 256/24 |

*Primary Examiner*—Andrew V. Kundrat

*Attorney, Agent, or Firm*—Kinney, Lange, Braddock, Westman and Fairbairn

[57] ABSTRACT

A picket fence has a plurality of light weight plastic fence pickets that can be snapped together with other like fence pickets to form either a solid fence or a fence having a space between upright members. Each fence picket includes a rigid member and a plurality of substantially horizontal members fixedly attached to the upright member. The fence pickets are held together by a plurality of pegs located on the portion of the horizontal member adjacent to the upright member and a plurality of apertures through each of the horizontal members. The pegs have a stem and a button top of substantially the same size as the aperture. The peg of the fence picket passes through the aperture of another fence picket and the button top of the peg holds the pickets together. The button tops may be slightly larger than the apertures and the horizontal members may be mildly flexible to enable the button tops to be pushed through the aperture.

11 Claims, 12 Drawing Figures

PICKET FENCE

BACKGROUND OF THE INVENTION

1. Field of the Invention

This invention relates to light weight, mobile, fences and in particular to such fences that are easily storable when not in use.

2. Description of the Prior Art

The most noted prior art fence within the field of the invention is the standard wooden/wire snow fence. This type of moveable fencing, however, has many drawbacks. It is relatively heavy, restricting the length of any particular section of fencing. It also has to be rolled up for storage, making a rather bulky package. Further, splicing of short sections of snow fencing leaves much to be desired since the splices are usually made with whatever material is found within the proximate vicinity. In addition, this type of snow fence is not very attractive in appearance.

More recent prior art shows no solution for a mobile and lightweight fence that can easily be stored. The Bouye U.S. Pat. No. 3,902,703 describes a lightweight modular plastic fence which could be considered mobile; however, it lacks the requisite overall flexibility that is needed for the applications that a snow fence is used for.

The Thomas U.S. Pat. No. 4,022,436 shows a lightweight, flexible and mobile section of fence. This fence, however, is designed to be used as a plant support and does not have the required rigidity that is needed for such uses as snow fencing or as an enclosure fence.

SUMMARY OF THE INVENTION

The present invention is a novel picket fence that is comprised of individual fence pickets snapped together. The individual fence pickets include a rigid upright member and a plurality of horizontal members fixedly attached to the upright member. A plurality of pegs are fixedly attached to the upright member and a plurality of apertures are defined within each horizontal member of the fence picket.

The fence pickets are snapped together by passing the pegs of one picket through the apertures of another fence picket. The pegs have a button shaped top which is preferably slightly larger than the aperture thereby locking the two fence pickets together.

The apertures are preferably arranged in three sets. Passing the pegs through the first set of apertures results in a privacy fence in which the upright members of each fence picket abut with upright members of adjacent fence pickets. Passing the pegs through the second set or the third set of apertures results in a space being left between the upright members, the third set of apertures leaving a larger space between the upright members than the second set. If the second or third set of apertures is used, the picket fence can be used as a snow fence or for any type of movable enclosure that doesn't need privacy.

By inserting the pegs in apertures that are not vertically aligned, it is possible to have the fence go up and down hills with a minimum of difficulty.

Since the present invention is of a modular type of construction, the length of fencing is not restricted by its weight. Sections of the fencing can be snapped and unsnapped as needed, producing the length that is needed. Further, sections of the fence pickets can be stored flat, thereby using a minimum amount of storage space. Lastly, splicing of fence sections is eliminated when using the individual fence pickets of the present invention since replacement pickets can be inserted in the same manner as the original pickets.

DETAILED DESCRIPTION OF THE PREFERRED EMBODIMENT

Figures 1, 2, 3, 4, 5, 6A, 6B, 6C:
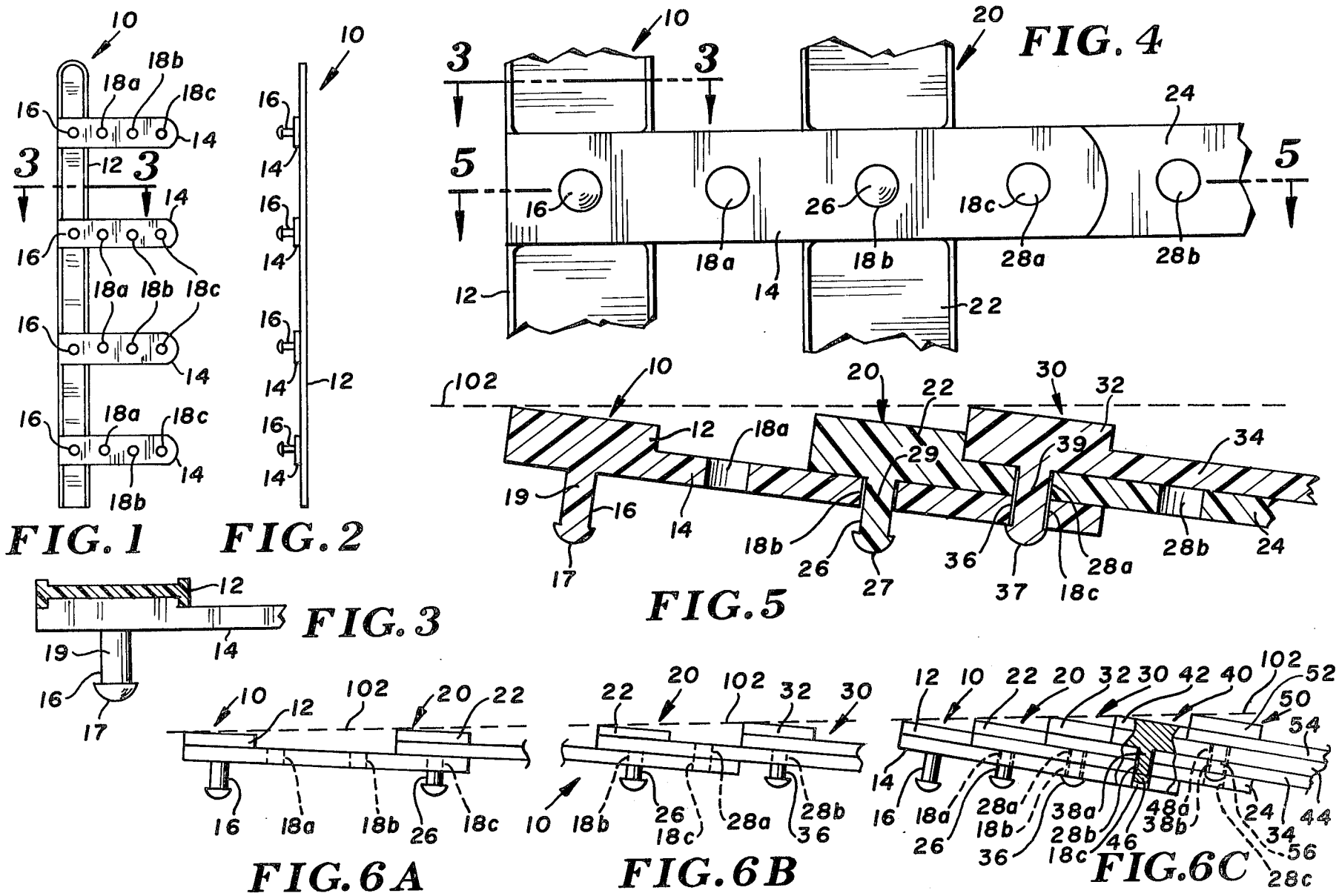
FIG. 1 is a front elevational view of the fence picket.
FIG. 2 is a side elevational view of the fence picket.
FIG. 3 is a fragmentary view with a portion in section taken along the line 3—3 in FIG. 4.
FIG. 4 is a fragmentary front view of two fence pickets which have been fastened together.
FIG. 5 is a view taken along the line 5—5 in FIG. 4.
FIG. 6A is a top view showing the widest spacing between upright members of the fence pickets.
FIG. 6B is a top view showing an intermediate spacing between upright members.
FIG. 6C is a top view showing a picket fence with no spacing between upright members.

FIGS. 1 and 2 show a front and side view of an individual fence picket 10 of the present invention. The individual fence picket has a rigid upright member 12 and a plurality of substantially horizontal members 14. In the preferred embodiment, there are four substantially horizontal members 14 spaced apart and fixedly attached to the upright member 12. The upright member 12 has preferably an "I" type cross-sectional construction, as shown in FIG. 3, to enhance rigidity. The upright member 12 is preferably made of any suitable synthetic polymer that will give the upright member 12 sufficient rigidity and the horizontal member 14 may be made of any suitable synthetic polymer that has a mildly flexible characteristic.

Preferably, a set of pegs 16 is fixedly attached on the portion of the horizontal member 14 that is adjacent to the upright member 12. A plurality of apertures preferably in sets **18*a*, 18*b* and 18*c*, extend through the horizontal members 14. The pegs 16 have shafts 19 and button tops 17**. When the pegs and the horizontal members are both made of a rigid material, the button top width is equal to that of the aperture. The button tops of the pegs will tend to prevent withdrawal of the pegs from the apertures.

A mildly flexible material may be employed for the peg. The shaft width is preferably slightly less than the aperture width and the button top width slightly greater than the aperture width. A mildly flexible peg can be snapped into the aperture. In either case, the peg is made from a suitable synthetic polymer or other suitable synthetic plastic material.

The apertures on the horizontal member 14 are arranged in three sets **18*a*, 18*b* and 18*c*. The first set 18*a* is spaced a distance of approximately one-half the width of the upright member from the upright member. All the apertures 18*a* are in the same vertical plane. The second set of apertures 18*b* is spaced approximately the width of the upright member 12 from the first set of apertures 18***a* and lie in the same horizontal plane as the apertures 18*a*. The set of apertures 18*b* all lie in the same vertical plane. The third set of apertures 18*c* is also spaced a distance approximately the width of the upright member 12 from the set of apertures 18*b* and lie in the same horizontal plane as the sets of apertures 18*a*, 18*b*. Similarly, all the apertures in the set 18*c* lie in the same vertical plane.

The pegs 16 are all in the same vertical plane, the vertical plane being approximately the midpoint of the width of the upright member 12. The pegs 16 are also in the same horizontal plane as the apertures 18*a*, 18*b* and 18*c*.

The embodiments in the remaining figures will be described, using reference characters based on those used in the description of the embodiment of FIGS. 1, 2 and 3. For example, the first picket in a series will be referred to as 10 and the second picket as 20 and the third as 30. The elements of each fence picket will be referred to in a similar manner. The horizontal member of the first fence picket will be referred to as 14, the horizontal member of the second fence picket will be referred to as 24 and the horizontal member of the third fence picket will be referred to as 34. The left numeral designates the individual fence picket and the right numeral designates the particular element of the fence picket.

FIGS. 4 and 5 show two fence pickets locked together by the pegs 26 of the fence picket 20 engaging the apertures 18*b* of the fence picket 10. The shafts of the pegs 16 are preferably at least twice as long as the depth of the apertures 18*a*, *b* and *c* in order to accommodate two horizontal members adjacent to each other. This is best seen in FIG. 5 wherein a sectional view of a fence picket shows a peg 36 of a fence picket 30 passing first through an aperture 28*a* of fence picket 20 and then through an aligned aperture 18*c* of the fence picket 10. Subsequent fence pickets are added, choosing the proper set of apertures for the spacing desired between the upright members to form the picket fence of the present invention.

FIG. 6A shows the pegs 26 of post 20 engaging apertures 18*c* of the fence picket 10, thereby leaving a space between the upright members 12 and 22 of approximately twice the width of an upright member. Each peg 26 passes through only one aperture 18*c* and thus sticks out a distance equal to the depth of one aperture. This particular configuration of the picket fence of the present invention allows the widest spacing between upright members.

FIG. 6B shows an intermediate spacing between upright members 22 and 32 of posts 20 and 30. The pegs 26 of the fence picket 20 pass through apertures 18*b* of the fence picket 10 and pegs 36 of fence picket 30 pass through apertures 28*b* of fence picket 20. No pegs engage the aligned apertures 28*a* of fence picket 20 and apertures 18*c* of fence picket 10, resulting in a spacing between upright members 22, 32 of approximately the width of one upright member.

FIG. 6C shows upright member 12 of fence picket 10, upright member 22 of fence picket 20, upright member 32 of fence picket 30, upright member 42 of fence picket 40, and upright member 52 of fence picket 50, with no space between upright members. In this particular configuration, when adding the fourth and subsequent pickets, three apertures of different fence pickets are aligned to receive one peg. Since the shaft of the peg is preferably only long enough to engage two aligned apertures, the third aligned aperture will be left unbuttoned and will only receive a portion of the button top of the peg. This is shown in the cutaway portion of FIG. 6C wherein peg 46 is engaging apertures 38*a* and 28*b*. Only the button top of peg 46 engages the aperture 18*c* and if the button top width is slightly larger than the width of the apertures 18*c*, the horizontal member 14 will not lie against the horizontal member 24 of the fence picket 20. Even though the peg 46 does not extend through aperture 18*c* of picket 10, the fence is still securely fastened together. The pegs of each picket always extend through at least one aperture of another picket. In every case except the first picket 10, the pegs of each picket extend through corresponding apertures of two other pickets.

Figure 7:
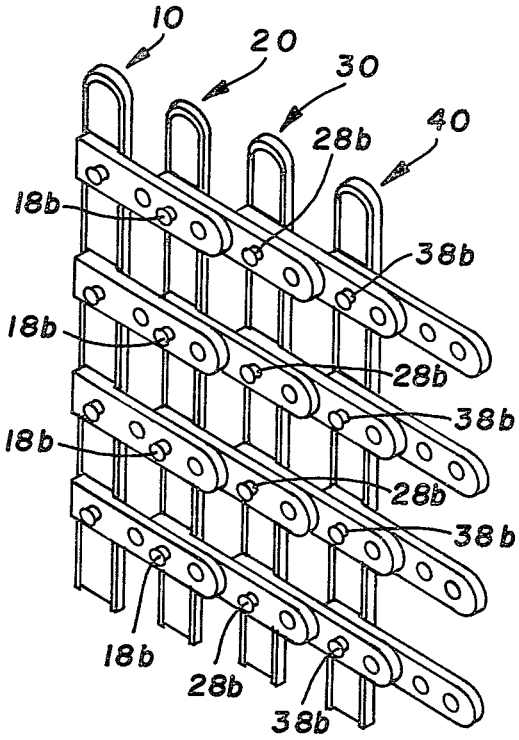
FIG. 7 is a perspective view of a picket fence having intermediate spacing between upright members.

FIG. 7 is a perspective view of the picket fence configuration as was described with reference to FIG. 6B. The pegs of the fence pickets 20, 30 and 40 are engaging aperture sets 18*b*, 28*b* and 38*b*, respectively, this particular configuration results in an intermediate spacing between upright members of approximately the width of one upright member. The intermediate spacing approximates the spacing between the wood slats of a wooden/wire snow fence and is particularly useful as a snow fence with the additional feature of being lighter in weight. Further, the picket fence of the present invention may be easily stored in light flat sections during the summer and, in the fall, snapped together by sections to form a snow fence.

Figure 8:
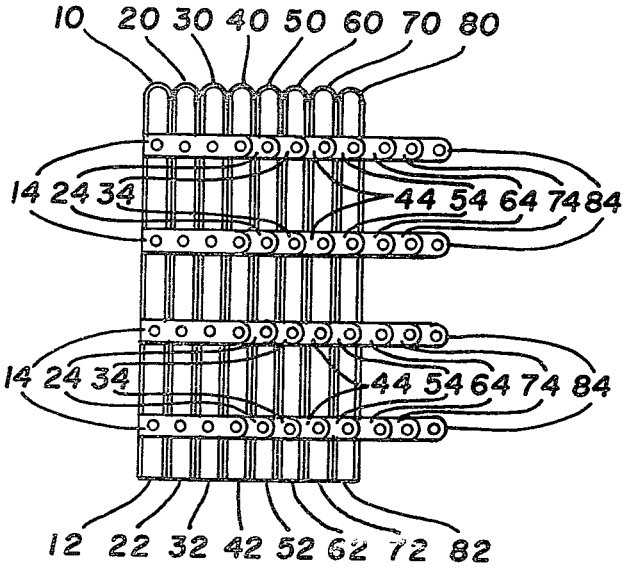
FIG. 8 is a front elevational view of the fence pickets with no spacing between the upright members.

FIG. 8 is a front view of the picket fence configuration as described with reference to FIG. 6C. This configuration of the picket fence is particularly useful as privacy fencing since there is no spacing between upright members of the fence picket.

Figure 9:
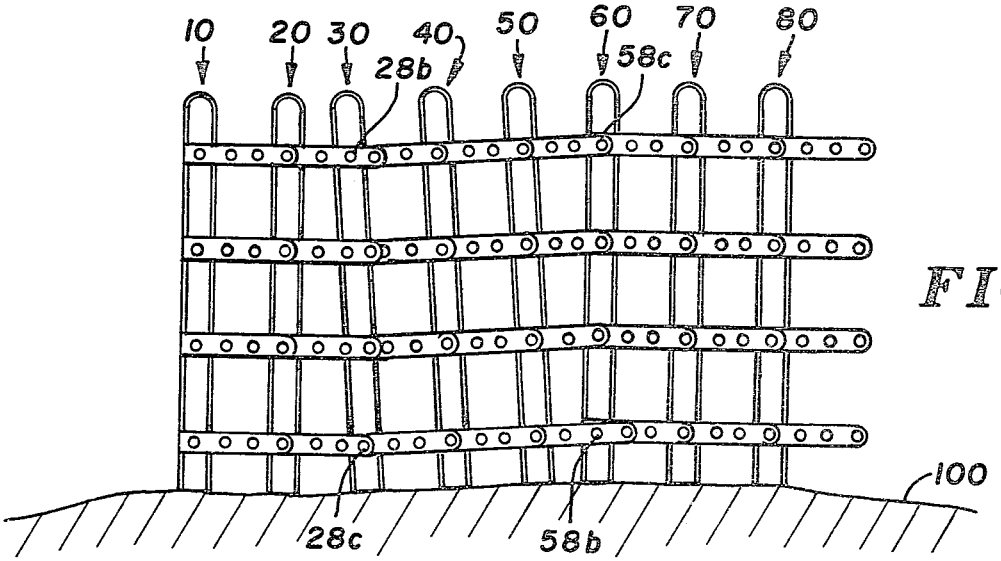
FIG. 9 shows a front elevation view of the fence picket on uneven terrain.

The picket fence can be made to also conform with uneven terrain, as best seen in FIG. 9. The highest peg of fence picket 30 is shown engaging aperture 28*b* of fence picket 20 while the lowest peg of fence picket 30 is shown engaging aperture 28*c* of fence picket 20, allowing the picket fence to conform to a change in the ground surface 100. Similarly, the highest peg of fence picket 60 is shown engaging aperture 58*c* and the lowest peg is shown engaging aperture 58*b* of fence picket 50, again allowing the picket fence to conform to a change in the ground surface 100.

Figure 10:
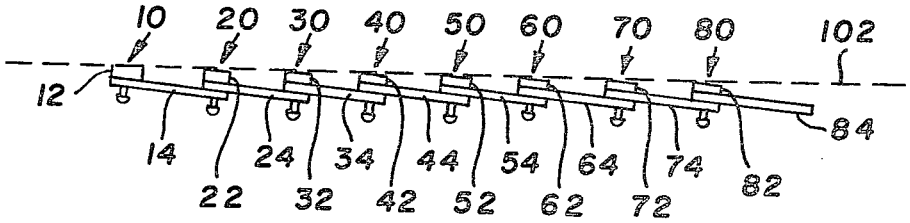
FIG. 10 is a top view taken of a section of the fence with the spacing shown in FIG. 6A.

FIG. 10 shows a top view of the present invention secured to fence posts (not shown) disposed along a fence line 102. Securing the picket fence to fence posts will slant the upright members 18, 22, 32, 42 through 82 with respect to the fence line 102. The horizontal members 14, 24, 34, 44 through 84 preferably being made from a mildly flexible material can compensate for the slanting by bending slightly.

It will be seen that the present invention provides for a readily assembled and disassembled fence which is light in weight and attractive in appearance. The pickets can, for example, be molded of plastic of any suitable color to give a desired decorative effect.

Although the present invention has been described with reference to preferred embodiments, persons skilled in the art will recognize that changes may be made in form and detail without departing from the spirit and scope of the invention.

What is claimed is:

1. A picket fence comprising:

a plurality of fence pickets, each fence picket comprising a substantially rigid upright member and a plurality of horizontal members fixedly secured to the rigid upright member and projecting outwardly from one face thereof across the width of said upright member;

a plurality of vertically spaced pegs fixedly secured to the portions of the horizontal members where they project across the width of the upright member of the fence picket and projecting outwardly therefrom;

the horizontal members of each fence picket having a plurality of apertures therethrough for receiving said pegs; and means for retaining said pegs within said apertures.

2. A picket fence as described in claim 1 in which there is at least one aperture within each horizontal member, said apertures being in the same vertical plane and forming a first set of apertures, in which the pegs are fixedly attached to the portion of the horizontal member projecting across the width of the rigid upright member, all the pegs being in the same vertical plane, there being one peg corresponding to each horizontal member and in the same horizontal plane as the apertures of the first set.

3. A picket fence as described in claim 2 in which there is a second set of apertures with one aperture of the second set within each horizontal member and in the same horizontal plane as the corresponding aperture of the first set, said apertures of the second set all being in the same vertical plane.

4. A picket fence as described in claim 3 in which there is a third set of apertures with one aperture of the third set within each horizontal member and in the same horizontal plane as the corresponding apertures of the first and second set, said apertures of the third set all being in the same vertical plane.

5. A picket fence as described in claim 2 wherein said upright members are in an abutting relationship with each other to form a solid fence, the pegs of each picket passing through the first set of apertures of the adjacent picket, said first set of apertures being horizontally spaced from the upright member of its associated picket by a distance of one-half the width of the upright member.

6. A picket fence as described in claim 3 wherein the upright members have a space between them, the pegs of each picket passing through the second set of apertures of the adjacent picket, said second set of apertures being horizontally spaced from the first set of apertures of the same horizontal member by a distance equal to the width of the upright member of the associated picket.

7. A picket fence as described in claim 4 wherein the upright members have a space between them equal to approximately the width of two upright members, the pegs of each picket passing through the third set of apertures of the adjacent picket, said third set of apertures being horizontally spaced from the second set of apertures a distance equal to the width of an upright member.

8. A picket fence as described in claim 1 wherein the number of substantially horizontal members is four.

9. A picket fence as described in claim 1 wherein the fence pickets are made from a synthetic plastic material.

10. A picket fence as described in claim 1 wherein each peg includes a shaft member and a button top member, said shaft member having a transverse width smaller than the transverse width of the apertures and the button tops having a transverse width slightly larger than that of the apertures.

11. A picket fence as described in claim 10 wherein the substantially horizontal members are made of a mildly flexible material.

* * * * *